US009956467B2

(12) United States Patent
Vehslage

(10) Patent No.: US 9,956,467 B2
(45) Date of Patent: May 1, 2018

(54) ATHLETIC TRAINING DEVICE

(71) Applicant: Randy Vehslage, Eldersburg, MD (US)

(72) Inventor: Randy Vehslage, Eldersburg, MD (US)

( * ) Notice: Subject to any disclaimer, the term of this patent is extended or adjusted under 35 U.S.C. 154(b) by 0 days. days.

(21) Appl. No.: 15/237,227

(22) Filed: Aug. 15, 2016

(65) Prior Publication Data

US 2017/0189781 A1 Jul. 6, 2017

Related U.S. Application Data

(60) Provisional application No. 62/204,709, filed on Aug. 13, 2015.

(51) Int. Cl.
*A63B 69/36* (2006.01)

(52) U.S. Cl.
CPC .. *A63B 69/3608* (2013.01); *A63B 2208/0204* (2013.01)

(58) Field of Classification Search
CPC ..... A63B 69/3608; A63B 69/0059
USPC ..... 473/277, 266, 215, 458, 274
See application file for complete search history.

(56) References Cited

U.S. PATENT DOCUMENTS

| | | | | |
|---|---|---|---|---|
| 7,740,544 | B2 * | 6/2010 | Williams | A63B 69/3608 473/212 |
| 8,562,451 | B2 * | 10/2013 | Crabtree | A63B 69/3608 473/215 |
| 2007/0243956 | A1 * | 10/2007 | Harris | A63B 21/0608 473/458 |
| 2014/0274435 | A1 * | 9/2014 | Licata | A63B 69/3608 473/215 |

* cited by examiner

*Primary Examiner* — Alvin Hunter
*Assistant Examiner* — Rayshun Peng

(57) ABSTRACT

Described herein is an athletic training device to aid a user in hip rotation, specifically to help the user increase the strength and speed of the rotation motion of his or her hips for improving performance in sports activities. The present invention is a device to be worn by a user as an athletic training or exercising aid, or a therapeutic aid, helping the user to maintain proper body alignment during a specific body movement involving the hips. In one embodiment, the device comprises a base from which extends an arm, the arm attached to the base by a pivot or hinge point, that allows the arm to move along a linear arc when force is applied to the device, such as the force exerted by a user upon rotation of the hip.

16 Claims, 6 Drawing Sheets

400
404
410
401

410
404

404
410
403

ATHLETIC TRAINING DEVICE

CROSS REFERENCE TO RELATED APPLICATIONS

This application claims priority to U.S. provisional patent application No. 62/204,709, filed on Aug. 13, 2015, the contents of which are hereby incorporated by reference in their entirety.

FIELD OF THE INVENTION

This invention relates generally to the field of athletic training devices, and more particularly to a hip rotation training device.

BACKGROUND

Many sports activities, whether throwing a swinging a bat, racquet, or golf club derive their power from the rotation of the hips. There exists a need for a portable device that can be used to improve the strength or speed of hip motion, so important to many sport activities. There also exists a need to provide feedback that would indicate that a user, whether utilizing a device as a training aid for golf, baseball, tennis or karate, is engaged in a proper hip rotation movement.

SUMMARY

Described herein is an athletic training device to aid a user in hip rotation, specifically to help the user increase the strength and speed of the rotation motion of his or her hips for improving performance in sports activities. The present invention is a device to be worn by a user as an athletic training or exercising aid, or a therapeutic aid, helping the user to maintain proper body alignment during a specific body movement involving the hips.

In one embodiment, the device comprises a base from which extends an arm, the arm attached to the base by a pivot or hinge point, that allows the arm to move along a linear arc when force is applied to the device, such as the force exerted by a user upon rotation of the hip.

In one embodiment, the device is configured to permit a user to accelerate the turn of their hip before other parts of the body in a motion that reflects the proper turn sequence that has applications in many different types of athletic endeavors, including a golf swing, or batting swing in baseball, or form movement in karate. The device allows athletes to create better hip rotation, and forces the hip to clear before the other shifting sequences is made in the proper method. The device solves the problem of allowing a user to feel the shift of the hip while practicing, and provides feedback, by way of signaling the user through the action of the arm as it moves against the body of the user, to let them know that the hip is moving first and creating the proper sequence for the correct power source.

Presently available training devices provide no way of telling that a user's hips are rotating correctly, because they lack the feedback signal/mechanism provided by the device of the present invention. In one embodiment, the training device is configured as a hip-flip device, wherein the device is worn on the body of the user and moves (flips) from a first position to a second position along the user's hip region, following movement of a hip rotation, such as when the wearer of the device has completed a golf swing or baseball swing motion, and provides feedback in the way of contact of the arm of the device, with a region of the hip (front or back, depending on the direction of movement).

DETAILED DESCRIPTION OF THE INVENTION

Figure 1A:
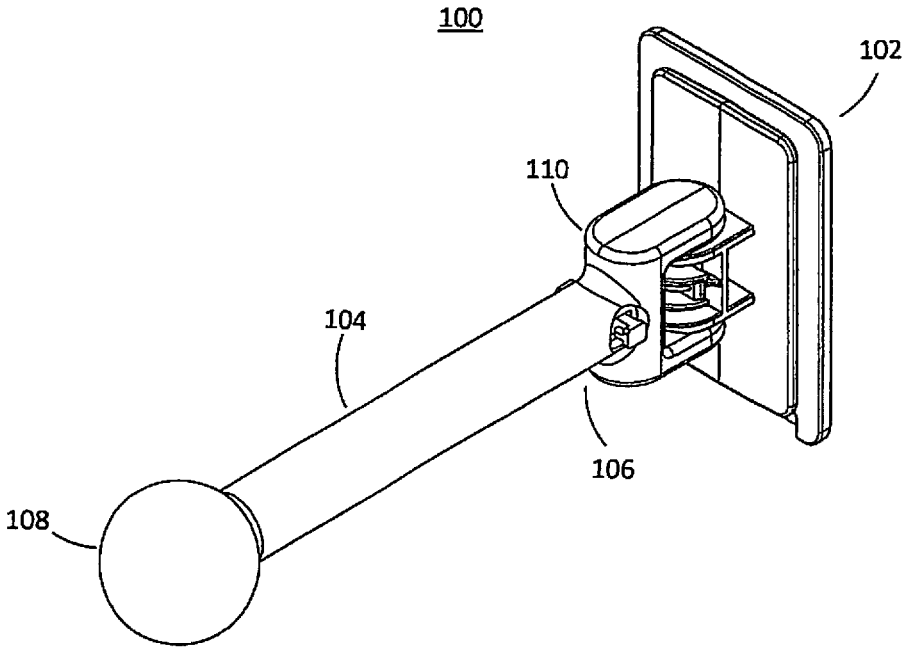
FIG. 1A shows a top front right isometric view of a device according to one embodiment of the invention.

In one embodiment, an athletic training device comprises an arm extending from a hinge point (pivot member) comprised of a coupling device which allows the attached arm member to swing about a linear axis; a base, wherein the base is attached to the hinge member; and attachment means for securing the device to a user, wherein the device is configured as a waist belt or configured as a detachable device for securing to a user near the hip joint, such as by attachment to user's clothing or waist belt.

In one embodiment, the arm member comprises a rod-like extension with a proximal end fastened to the base via the hinge member. In another embodiment, the arm comprises a distal end, the distal end configured with a rounded shape that, ideally, makes contact with a portion of the user's body upon completion of a hip rotation, which engages the arm to move from the first position (extended away from the user's body) to the second position (a positioned adjacent to the user's body).

In one embodiment, the arm is moveable freely along an axis in a range up to 200 degrees, wherein the arm member moves from a resting position along an axis of rotation in response to the force of movement applied to the device. In another embodiment, the distal portion of the arm is configured with a weighted portion, connected to, co-located, or within, the distal end of the arm. The weighted portion may be configured with suitable materials that impart weight to the end of the arm, thereby aiding in the feedback mechanism when the distal end makes contact with a hip portion following completion of a hip rotation movement.

In one embodiment, the arm member is made of one or more natural or synthetic materials, including but not limited to metal, plastic, rubber, recycled materials, or any suitable materials or combination thereof.

In one embodiment, the arm is configured as a cylindrical or tubular rod-shaped extension with a head configured as a bulbous region. The arm may be hollow or solid, depending on the materials used and the weight desired for the arm or the arm end region (head). In one embodiment the rounded end region has a diameter that is commensurate with or greater than the diameter of the arm region. In one embodiment, the rounded end region of the arm comprises a diameter of up to 0.5 inches or ranging up to several inches. In one embodiment, the arm member comprises a diameter in a range of 0.25 inches or more, up to several inches in diameter. The width may be constant along the length of the extension, or variable depending on the design, materials or desired weight. The arm may be made of various materials, including plastic, lightweight metal, rubber, or other synthetic or natural materials or combinations thereof. The arm and arm head may be of different materials, for example, the arm length may be made of metal or plastic, with the arm head made of rubberized materials, plastic or other synthetic materials.

In one embodiment, the arm is of a length in a range varying from up to 3 inches in length, to up to 12 inches in length, depending in large part on the user's height and girth. Thus, it is envisioned that the device may be configured with varying diameters and lengths, as appropriate in order to offer sizes that are compatible with a user. For example, a smaller diameter and length would be more appropriate on a device configured for use by a petite individual, whereas a larger-sized device would be more appropriate for a larger or taller individual.

In another embodiment, the base of the device is configured with attachment means for securing the device to a user, such as to an article of clothing. In one embodiment, attachment means comprise a clip, a snap, a tie, a magnetic fastener, or other suitable means for (reversibly) attaching the device for use. In yet another embodiment, the base is configured as a waist belt or waist band and can be secured around a user's hip by various fastening means, including but not limited to buckles, ties, clips buttons, snaps or Velcro.

In one embodiment, the hinge is configured for interconnecting the base and the proximal end of the arm by extending from the base for partial enclosure flanged portions/extension connecting to the distal end of the arm. The extensions are connected to the hinge by securing a snap feature found on the inner surface of the flanged ends of the arm with corresponding features on the hinge. In one embodiment, the hinge further comprises portions adapted to define a linear arc through which the arm rotates when the arm is interconnected at the hinge with the base. In one embodiment, proximal end of arm is configured with an adjustment pin for control of pressure on am. The hinge is further configured to have provide a longitudinal axis aligned generally vertically. In one embodiment, the hinge has an overall dimension that is greater than the diameter of the arm.

While the base is shown in the figures as generally rectangular, it may be of varying shape, dimensions and thickness. The base and hinge may be made of various materials including but not limited to: plastic, rubber, metal, or other natural or synthetic materials, or a combination thereof.

In one embodiment, a portable device for detecting movement of a person's hips comprises a base adapted to be mounted on or proximate to the hips of the person; an arm having a proximal end rotatably connected to the base, and a distal end opposite the proximal end; a hinge located between and interconnecting the base and the proximal end of the arm, the hinge having portions adapted to define a linear arc through which the arm rotates; wherein the linear arc is defined by first and second halves and wherein the arm is rotatable between an initial position in the first half of the linear arc and a second position in the second half of the arc; wherein, when the base is mounted to the person, the hinge is configured to have a longitudinal axis aligned generally vertically, configured to orient the linear arc transversely to the longitudinal axis and in a horizontal plane generally in line with the person's hips, and configured to locate the first half of the linear arc toward a first one of the hips of the user and the second half of the linear arc toward a second one of the hips of the user; a first contact point for the arm defined by a first portion of the arm opposing at least one of the base and the first hip when the arm is in the first half of the linear arc; a second contact point for the arm defined by a second portion of the arm opposing at least one of the base and the second hip; whereby, when the device is mounted and the arm is located in the first half of the linear arc, forward motion of the first hip relative to the second hip applies force to the first point of contact to direct the arm along the linear arc from the first half of the arc toward the second half of the linear arc.

In one embodiment, the arm is connected to the base and relative to the first and second points of contact to define an arc length of the linear arc of between 150° and 200°.

In another embodiment, the arm is connected by the hinge to the base to rotate between the first and second points of contact long the linear arc in response to a predetermined therapeutic movement of the first hip relative to the second hip. In one embodiment, the arm is connected by the hinge to the base to rotate between the first and second points of contact long the linear arc in response to a predetermined sports movement, such as a golf swing, a tennis stroke, a bat swing, a karate form, and a ball toss.

In another embodiment, the proximal end includes first and second laterally spaced, opposite arm surfaces, wherein the base includes two flange portions extending laterally from the hinge, and wherein each of the flange portions are located to contact a corresponding one of the arm surfaces to define an outer limit to the angular length of the linear arc.

In one embodiment, a portable training device for a proper hip alignment and rotation comprises: a base adapted to be mounted on or proximate to the hips of the user; an arm having a proximal end rotatably connected to the base, and a distal end opposite the proximal end; a hinge located between and interconnecting the base and the proximal end of the arm, the hinge having portions adapted to define a linear arc through which the arm rotates; wherein the linear arc is defined by first and second halves and wherein the arm is rotatable between an initial position in the first half of the linear arc and a second position in the second half of the arc; wherein, when the base is mounted to the user, the hinge is configured to have a longitudinal axis aligned generally vertically, configured to orient the linear arc transversely to the longitudinal axis and in a horizontal plane generally in line with the user's hips, and configured to locate the first half of the linear arc toward a first one of the hips of the user and the second half of the linear arc toward a second one of the hips of the user; a first contact point for the arm defined by a first portion of the arm opposing at least one of the base and the first hip of the user when the arm is in the first half of the linear arc; a second contact point for the arm defined by a second portion of the arm opposing at least one of the base and the second hip of the user; whereby, when the device is mounted and the arm is located in the first half of the linear arc, forward motion of the first hip relative to the second hip applies force to the first point of contact to direct the arm along the linear arc from the first half of the arc toward the second half of the linear arc.

Figure 1B:
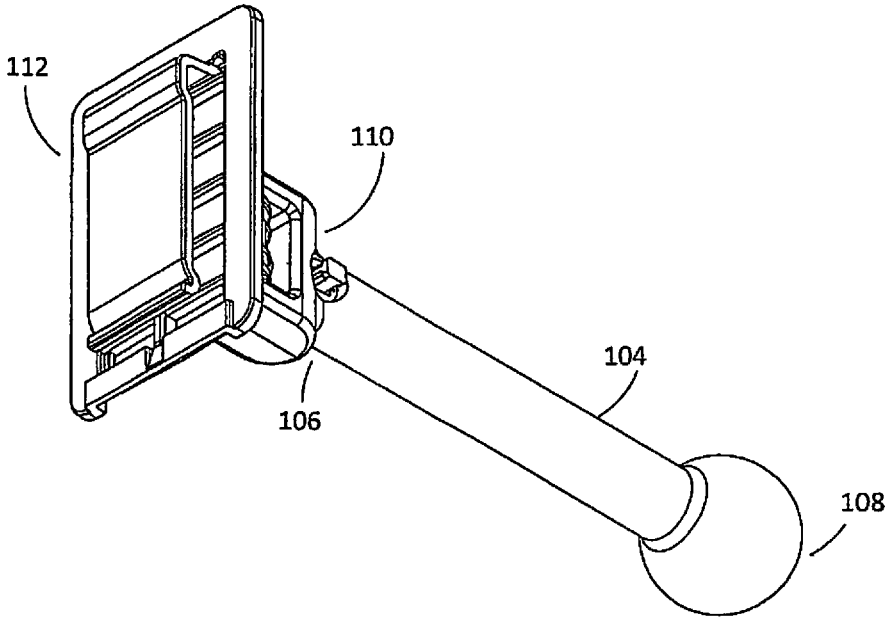
FIG. 1B shows a bottom rear right isometric view of a device according to one embodiment of the invention.

Details of the invention are further shown by the attached illustrations. FIG. 1A/B show training device 100 comprising base 102, arm 104 of a rod-like shape, the arm having a proximal end 106 movably connected to the base 102 and a distal end 108 opposite the proximal end 106, and shown in the figure with a curved circular head with a diameter slightly greater than the diameter of the arm, and a hinge 110 located between and interconnecting the base 102 and the proximal end 106 of arm 104. Also shown are attachment means 112 in FIG. 1B.

Figure 2:
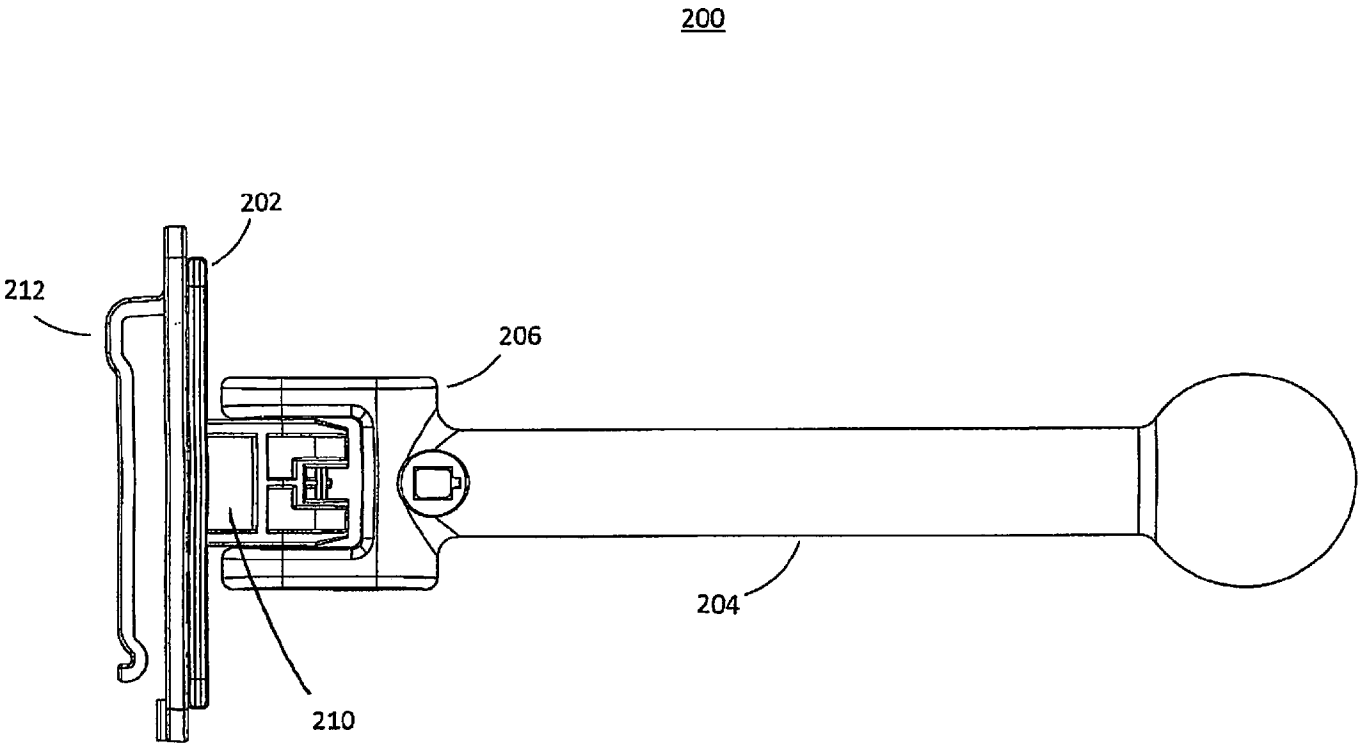
FIG. 2 shows a left side view of a device according to one embodiment of the invention.

FIG. 2 shows a side view of device 200 comprising base 202, arm 204 with proximal end 206 moveably connected to base 202 by hinge 210 interconnected between flanged ends of proximal end 206. Base 202 is outfitted with attachment means 212, in this examples shown as a clip, for securing device 200 to the waist belt of a user.

Figure 3:
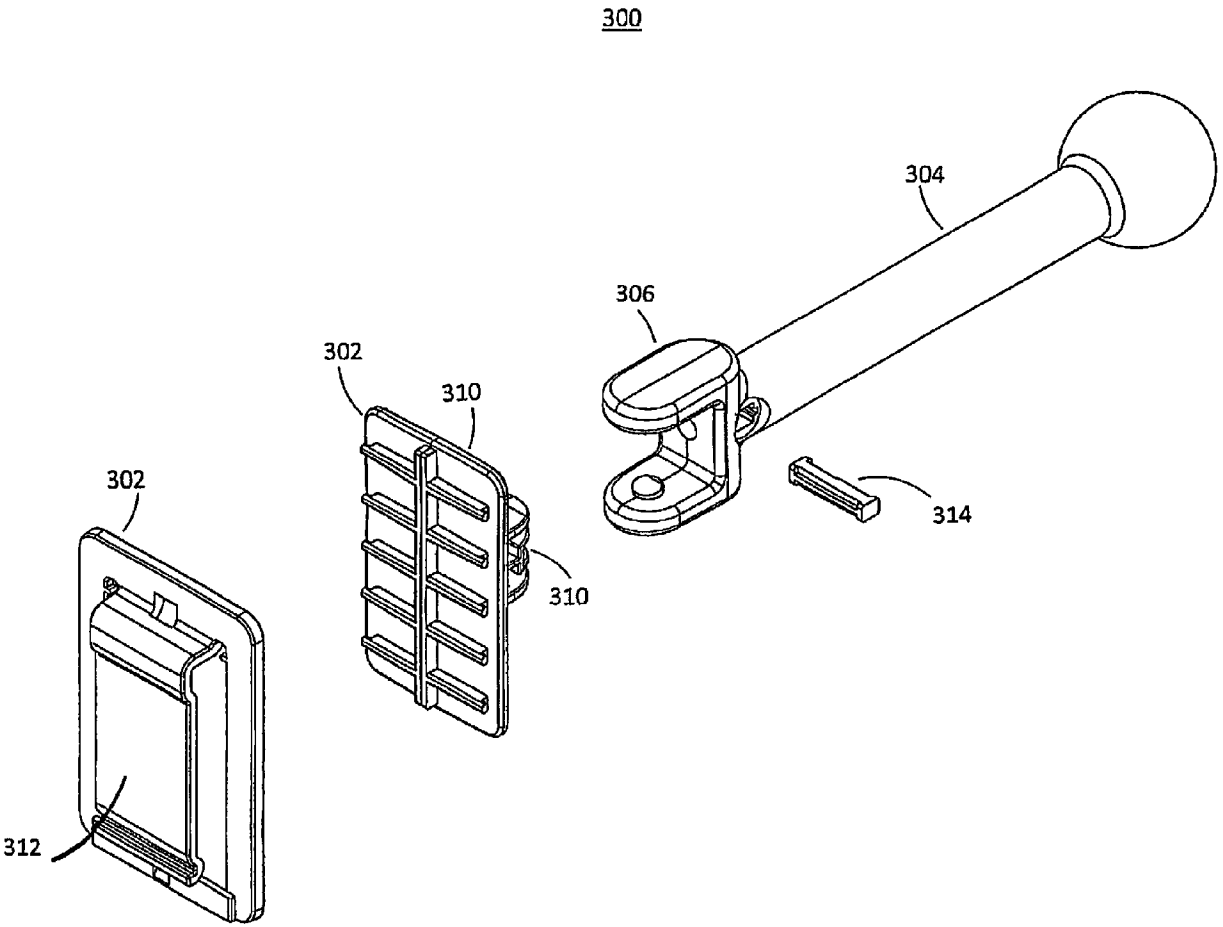
FIG. 3 shows a rear left isometric exploded view of a device according to one embodiment of the invention.

FIG. 3 shows an expanded side rear view of device 300 showing the interconnection of base 302 configured with attachment means 312, hinge 310, flanged ends of hinge 306 interconnected with proximal end of arm 304 and adjustment pin 314 used in one embodiment to secure arm 304 to hinge 310, although other securement mechanisms are envisioned. In another embodiment, a spring plunger 315 is inserted in the cavity created by the flanged ends 306 abutting proximal end of arm 304 and joins with plunger position 317 and joins plunger end 319 of spring plunger 315 with hinge 310. The plunger holds adjustment pin 314 in position and the arraignment results in an adjustment piece, and will move the plunger in-and-out, resulting in tension added to arm 304, so the user can make the arm move faster or slower, depending on the adjustment. For example, when adjustment pin 314 is inserted into a hole on 304, spring plunger 315 is added and snapped into position onto the front (arm-facing side) of hinge 310, which will control the amount of pressure on the arm 304 which moves against hinge 310.

Flanged ends 306 also secure around the inner hinge 310 member, surrounding a top and bottom portion of inner hinge 310, secured by one or more fastening members (shown in the figure as a protruding snap feature 321 engages a corresponding impression feature on hinge 310 (feature not shown) that results in a "click in position" of the flanged ends around the inner hinge feature, thereby resulting in a hinge assembly that permits freedom of movement of the flanged ends around the inner hinge—along a linear arc defined by hinge arrangement, and corresponding movement of the arm along the arc. In this embodiment, rotation and movement about the hinge member will be limited by the orientation of the hinge to the base (as shown in FIG. 4).

Figures 4A, 4B, 4C:
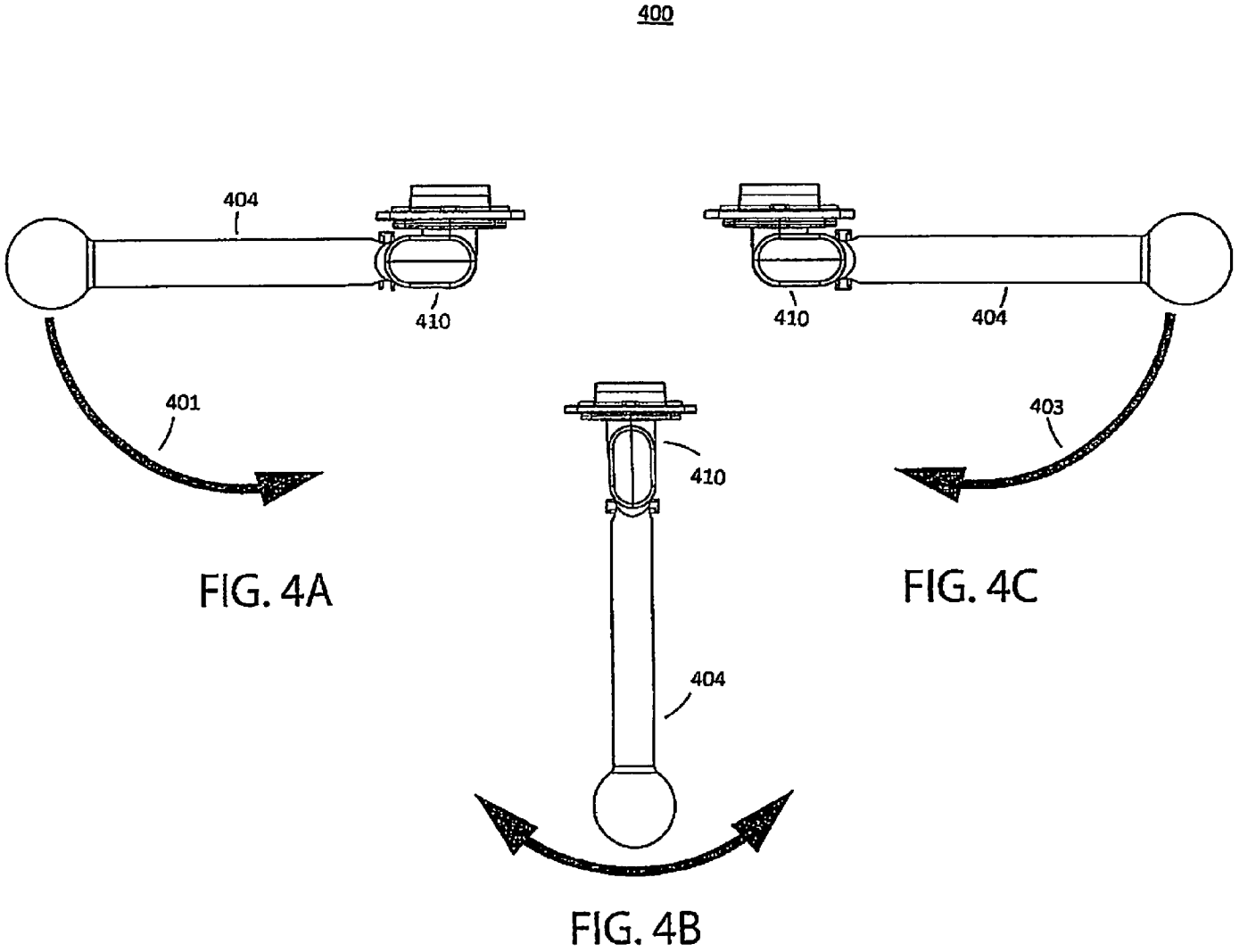
FIG. 4A/B/C shows a top view showing movement of a device according to one embodiment of the invention in response to a user's body movement.

FIG. 4 shows an illustration of device 400 as arm 404 rotates about the hinge point 410 in a range of movement along a first linear arc 401 to a first point of contact, and in a range of movement along a second linear arc 403 to a second point of contact.

Figure 5C:
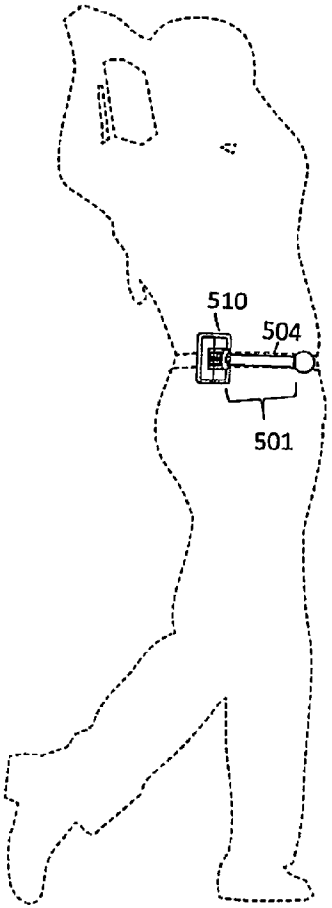
FIG. 5A/B/C shows a depiction of a golfer wearing the device during an exemplary training movement.
Figure 5B:
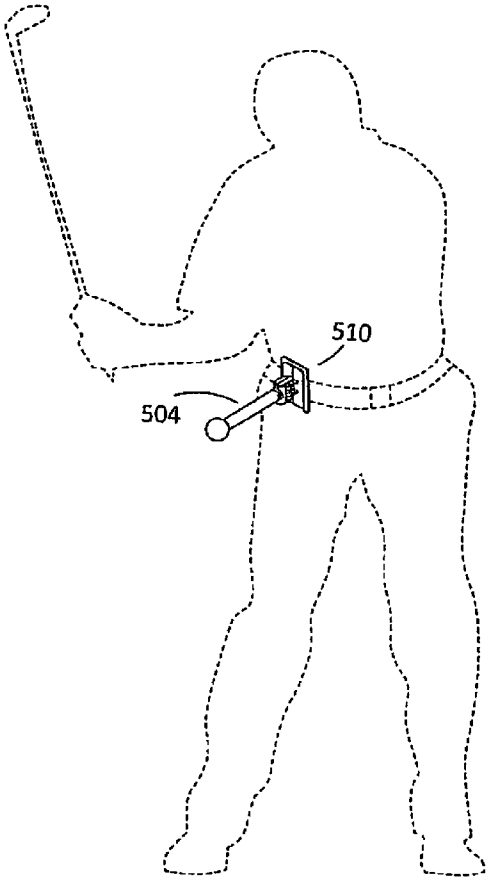
Figure 5A:
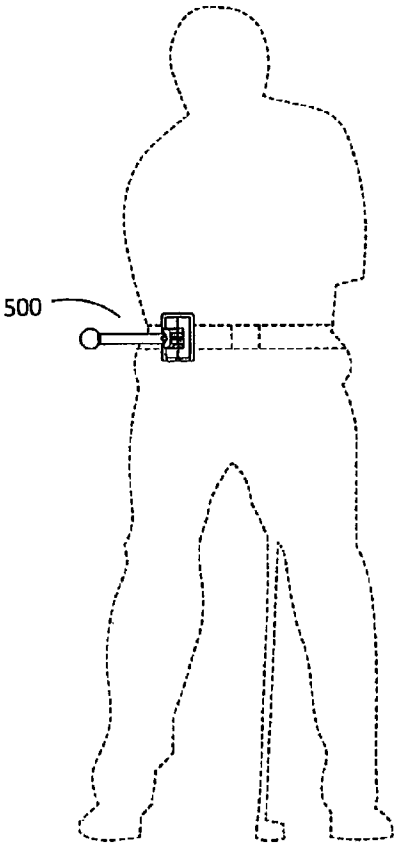

FIG. 5 shows an illustration of device 500 worn by a user engaged in athletic training for a gold swing. FIG. 5A shows the stationary position of device 500, shown here attached to along a belt worn by a user. In FIG. 5B/C, the user has torqued their body position into the start of a golf swing, and the arm 504 moves in response to the force exerted by the hip motion, and rotates about the hinge point 510 in a range of movement along a first linear arc 501 to approach a first point of along the waist of the user.

Figure 6:
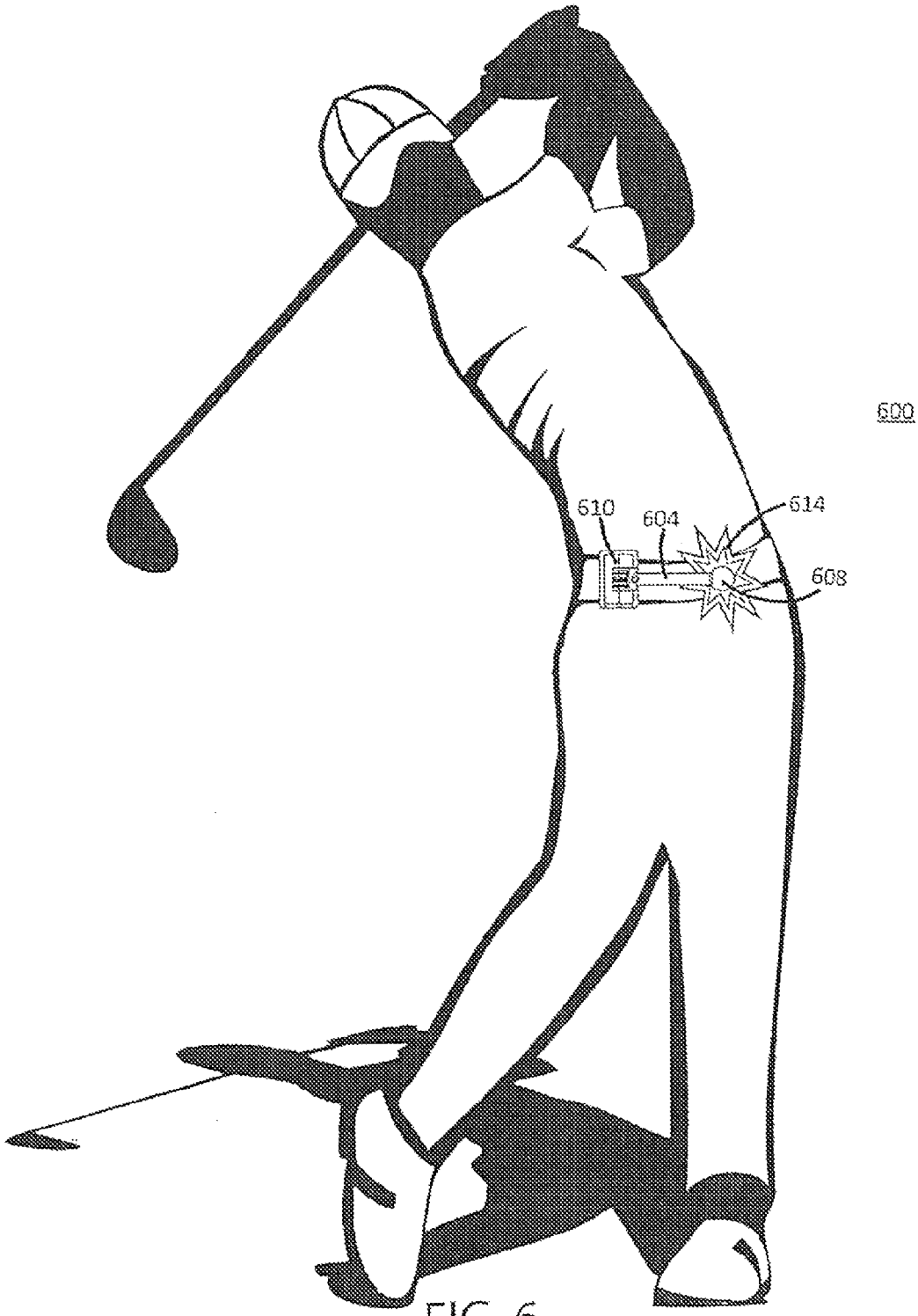
FIG. 6 shows an illustrative depiction of the feedback to the user engaged in training while wearing the device; the figure shows that upon completion of a hip rotation the device provides feedback to the user as it makes contact with the users hip/waist belt (depicted in the figure by visual indication of sound produced in response to contact).

FIG. 6 shows a depiction of a golfer practicing a golf swing and wearing device 600 secured along a waist belt. Upon movement and rotation of the golfer's hip during the golf swing, arm 604 of device 600 moves from hinge point 610 in a direction along a linear arc to a contact position at the golfers waist belt (shown in the figure by the outline 614 presented around the contact point, thereby indicating sound of the distal end 608 of arm 604 hitting the golfer's waist belt.

It will be clear to a person skilled in the art that features described in relation to any of the embodiments described above can be applicable interchangeably between the different embodiments. The embodiments described above are examples to illustrate various features of the invention, and they are not exhaustive or exclusive.

Throughout the description and claims of this specification, the words "comprise" and "contain" and variations of them mean "including but not limited to", and they are not intended to (and do not) exclude other additives, components, materials or steps. Throughout, the singular encompasses the plural unless the context otherwise requires. In particular, where the indefinite article is used, the specification is to be understood as contemplating plurality as well as singularity, unless the context requires otherwise.

Features, materials, characteristics, described in conjunction with a particular aspect, embodiment or example of the invention are to be understood to be applicable to any other aspect, embodiment or example described herein unless incompatible therewith. The invention is not restricted to the details of any foregoing embodiments. The invention extends to any novel one, or any novel combination, of the features disclosed in this specification (including any accompanying claims, abstract and drawings), or to any novel one, or any novel combination, of the elements so disclosed.

The invention claimed is:

1. A portable device for detecting movement of a person's hips, the device comprising:

a base adapted to be mounted on or proximate to the hips of the person;

an arm having a proximal end rotatably connected to the base by a pair of arm extensions that permit freedom of movement of the arm, and a distal end opposite the proximal end;

an adjustable spring plunger and tension pin for creating tension to the arm and adjustable based on user preference;

a hinge located between and interconnecting the base and the proximal end of the arm, the hinge having portions adapted to define a linear arc through which the arm rotates;

wherein the linear arc is defined by first and second halves and wherein the arm is rotatable between an initial position in the first half of the linear arc and a second position in the second half of the arc;

wherein, when the base is mounted to the person, the hinge is configured to have a longitudinal axis aligned generally vertically, configured to orient the linear arc transversely to the longitudinal axis and in a horizontal plane generally in line with the person's hips, and configured to locate the first half of the linear arc toward a first one of the hips of the user and the second half of the linear arc toward a second one of the hips of the user;

a first contact point for the arm defined by a first portion of the arm opposing at least one of the base and the first hip when the arm is in the first half of the linear arc;

a second contact point for the arm defined by a second portion of the arm opposing at least one of the base and the second hip;

whereby, when the device is mounted and the arm is located in the first half of the linear arc, forward motion of the first hip relative to the second hip applies force to the first point of contact to direct the arm along the linear arc from the first half of the arc toward the second half of the linear arc.

2. The device of claim 1, wherein the arm is connected to the base and relative to the first and second points of contact to define an arc length of the linear arc of between 150° and 200°.

3. The device of claim 1, wherein the arm is connected by the hinge to the base to rotate between the first and second points of contact long the linear arc in response to a predetermined therapeutic movement of the first hip relative to the second hip.

4. The device of claim 1, wherein the arm is connected by the hinge to the base to rotate between the first and second points of contact long the linear arc in response to a predetermined sports movement.

5. The device of claim 4, wherein the predetermined sports movement comprises at least one movement selected from the group consisting of a golf swing, a tennis stroke, a bat swing, and a ball toss.

6. The device of claim 1, wherein the base includes portions adapted to secure the base at the waist.

7. The device of claim 1, wherein the proximal end includes first and second laterally spaced, opposite arm surfaces, wherein the base includes two flange portions extending laterally from the hinge, and wherein each of the flange portions are located to contact a corresponding one of the arm surfaces to define an outer limit to the angular length of the linear arc.

8. The device of claim 7, further comprising an adjustment pin located at the proximal end of the arm, the adjustment pin extending transversely through the arm and terminating in two opposite pin ends, and wherein the two opposite pin ends comprise the opposite arm surfaces, and wherein the adjustment pin controls an amount of pressure exerted on the arm.

9. The device of claim 1, further comprising:

a transverse aperture and at least one pin receivable therein in an interference fit to extend transversely through the arm, the pin having opposite pin ends and a predetermined length to locate the opposite pin ends at a corresponding predetermined lateral distance from portions of the proximal end adjacent to the pin;

the base comprising two flange portions extending laterally from the hinge, each of the flange portions located to contact respective ones of the pin ends to define an outer limit to the angle of the linear arc.

10. The device of claim 1, further comprising a weighted portion connected to and located at the distal end of the arm.

11. A portable training device for a golfer's swing, the device comprising:

a base adapted to be mounted on or proximate to the hips of the golfer;

an arm ranging in length from 3 inches to 8 inches and having a proximal end rotatably connected to the base, and a distal end opposite the proximal end;

an adjustable spring plunger and tension pin for creating tension to the arm and adjustable based on user preference;

a hinge located between and interconnecting the base and the proximal end of the arm, the hinge having portions adapted to define a linear arc through which the arm rotates;

wherein the linear arc is defined by first and second halves and wherein the arm is rotatable between an initial position in the first half of the linear arc and a second position in the second half of the arc;

wherein, when the base is mounted to the golfer, the hinge is configured to have a longitudinal axis aligned generally vertically, configured to orient the linear arc transversely to the longitudinal axis and in a horizontal plane generally in line with the golfer's hips, and configured to locate the first half of the linear arc toward a first one of the hips of the golfer and the second half of the linear arc toward a second one of the hips of the golfer;

a first contact point for the arm defined by a first portion of the arm opposing at least one of the base and the first hip of the golfer when the arm is in the first half of the linear arc;

a second contact point for the arm defined by a second portion of the arm opposing at least one of the base and the second hip of the golfer;

whereby, when the device is mounted and the arm is located in the first half of the linear arc, forward motion of the first hip relative to the second hip applies force to the first point of contact to direct the arm along the linear arc from the first half of the arc toward the second half of the linear arc.

12. The device of claim 11, wherein the base includes portions adapted to secure the base at the waist.

13. The device of claim 11, wherein the proximal end includes first and second laterally spaced, opposite arm surfaces, wherein the base includes two flange portions extending laterally from the hinge, and wherein each of the flange portions are located to contact a corresponding one of the arm surfaces to define an outer limit to the angular length of the linear arc.

14. The device of claim 13, further comprising an adjustment pin located at the proximal end of the arm, the adjustment pin extending transversely through the arm and terminating in two opposite pin ends, and wherein the two opposite pin ends comprise the opposite arm surfaces.

15. The device of claim 11, further comprising:

a transverse aperture and at least one pin receivable therein in an interference fit to extend transversely through the arm, the pin having opposite pin ends and a predetermined length to locate the opposite pin ends at a corresponding predetermined lateral distance from portions of the proximal end adjacent to the pin;

the base comprising two flange portions extending laterally from the hinge, each of the flange portions located to contact respective ones of the pin ends to define an outer limit to the angle of the linear arc.

16. The device of claim 11, further comprising a weighted portion connected to and located at the distal end of the arm.

* * * * *